US008397698B2

(12) United States Patent
Sharp et al.

(10) Patent No.: US 8,397,698 B2
(45) Date of Patent: Mar. 19, 2013

(54) COMPOSITE FUEL PUMP CARTRIDGE AND FUEL TANK ASSEMBLY

(75) Inventors: Thomas A. Sharp, South Lyon, MI (US); Michael R. Teets, Grosse Pointe Park, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 4 days.

(21) Appl. No.: 12/020,825

(22) Filed: Jan. 28, 2008

(65) Prior Publication Data

US 2009/0188473 A1 Jul. 30, 2009

(51) Int. Cl.
*F02M 37/04* (2006.01)

(52) U.S. Cl. ..... 123/509

(58) Field of Classification Search ..... 123/509, 123/195 C, 198 C; 220/562, 564, 601, 4.13, 220/574, 590, 642, 651, 654, 661; 137/574, 137/590

See application file for complete search history.

(56) References Cited

U.S. PATENT DOCUMENTS

| | | | | |
|---|---|---|---|---|
| 5,080,077 | A * | 1/1992 | Sawert et al. | 123/514 |
| 5,669,359 | A * | 9/1997 | Kleppner et al. | 123/509 |
| 5,762,047 | A * | 6/1998 | Yoshioka et al. | 123/509 |
| 6,014,957 | A * | 1/2000 | Robinson | 123/509 |
| 6,609,503 | B1 * | 8/2003 | Nakagawa et al. | 123/509 |
| 7,591,250 | B2 * | 9/2009 | Milton | 123/509 |
| 2007/0144495 | A1 | 6/2007 | Teets et al. | |

FOREIGN PATENT DOCUMENTS

DE 19821229 A1 * 12/1998

* cited by examiner

*Primary Examiner* — Stephen K Cronin
*Assistant Examiner* — Sizo Vilakazi
(74) *Attorney, Agent, or Firm* — Ralph E. Smith

(57) ABSTRACT

A fuel tank assembly comprising a fuel tank having a plurality of walls spaced apart by a floor, a flange having a top portion and a bottom portion, and extending downward from one of the plurality of walls, is provided. The fuel tank assembly further includes a housing, a crimp ring and a lip, wherein the crimp ring is fitted over the lip for engaging the flange and the housing. A fuel pump is housed within the housing, wherein the housing is arranged to fixedly position at least one inlet connected to the fuel pump at or in close proximity to the floor of the fuel tank. A fuel reservoir extends away from the floor having at least one passage formed therein, the fuel reservoir being positioned within the fuel tank so as to create an accumulated area of the fuel tank surrounding the at least one inlet, wherein fuel enters the accumulated area through the at least one passage for receipt by the at least one inlet.

20 Claims, 11 Drawing Sheets

COMPOSITE FUEL PUMP CARTRIDGE AND FUEL TANK ASSEMBLY

FIELD OF THE INVENTION

The present invention relates to fuel tank assemblies and more particularly to a composite fuel pump with an integrated flange and housing within a fuel tank assembly for a vehicle.

BACKGROUND OF THE INVENTION

In automotive vehicles, a fuel pump is typically disposed within a fuel tank assembly. The fuel pump draws fuel from the fuel tank through the fuel lines for supply to the engine. Known fuel tanks utilize mounted fuel pumps having an inlet arranged to receive fuel from a separately constructed reservoir tank arranged within the fuel tank, i.e. a tank within a tank. Such arrangements use supplemental pumps that are arranged to transfer fuel from the fuel tank to the reservoir tank, thus requiring additional mechanical energy. Consequently, such fuel tank assemblies utilizing fuel pumps tend to be more costly to assemble and difficult to access for service.

BRIEF SUMMARY OF THE INVENTION

A fuel pump draws fuel from the fuel tank, usually located in the rear of a vehicle, through fuel lines that run the length of the vehicle to the engine's injection system. The fuel pump disclosed herein is an electric fuel pump that is located inside the fuel tank. The fuel pump contains a direct current (DC) motor with an impeller mounted on the end of the motor shaft. A cover is mounted over the impeller, having inlet and discharge ports. When the armature rotates, thus rotating the impeller, fuel is moved from the fuel tank and into the inlet port of the fuel pump. The impeller grooves force the fuel out of the fuel pump, through the discharge port.

A fuel pump is located within the fuel tank to aid in keeping the fuel pump cool during operation, and aid in ensuring the fuel line is pressurized to prevent premature fuel evaporation. The pump is housed within a housing and enclosed by a fuel filter. The housing is engaged to a flange that fits within a cavity of the fuel tank located within a side wall or the top of the fuel tank. The top portion is located outside the fuel tank, and the bottom portion extends within the fuel tank.

Accordingly, one aspect of the present invention is to provide a fuel tank assembly comprising a fuel tank having a plurality of walls spaced apart by a floor. A flange extends downward from one of the plurality of walls. The flange may extend at an angle toward the floor, or extend from the top of the fuel tank toward the floor. A fuel pump extends from the flange; and the fuel pump and flange are arranged to fixedly position at least one inlet connected to the fuel pump at or in close proximity to the floor of the fuel tank. A filter surrounds the fuel pump for filtering the fuel, and a housing encompasses both the pump and filter. The fuel pump includes at least one inlet for drawing fuel into the housing, and the inlet is engaged to a suction filter for filtering the gas prior to entering the inlet. The flange is engaged to the housing by way of a crimp ring that is fitted over a lip, forming an engaged arrangement.

A fuel reservoir located within the fuel tank extends away from the floor and has at least one passage formed therein. The fuel reservoir is positioned within the fuel tank so as to create an accumulated area surrounding the at least one inlet. Fuel enters the accumulated area through the at least one passage and is received by the at least one inlet by way of the suction filter. Optionally, a channel is formed within the fuel reservoir for receiving at least one inlet from the fuel pump.

According to an exemplary embodiment of the present invention, a fuel pump assembly comprises a flange having a top portion and a bottom portion, and extending downward from one of the plurality of walls. The fuel pump assembly includes a housing, a crimp ring and a lip, wherein the crimp ring is fitted over the lip for engaging the flange and the housing. A fuel pump is housed within the housing, wherein the housing is arranged to fixedly position at least one inlet at or in close proximity to the floor of the fuel tank.

According to another embodiment of the present invention, the fuel tank assembly includes a fuel pump having at least one inlet for receiving fuel, the at least one inlet being in fluid communication with the pump.

According to yet another embodiment of the present invention, the fuel tank assembly includes a suction filter having an internal frame for shaping the suction filter into a predetermined form, wherein the suction filter is positioned to be at or in close proximity to the floor of the fuel tank, the suction filter being in fluid communication with the at least one inlet of the housing.

According to yet another embodiment of the present invention, the fuel tank assembly includes a housing enclosing a fuel filter disposed around the fuel pump, wherein the fuel filter forms the inner wall of the fuel filter.

According to yet another embodiment of the present invention, the fuel tank assembly includes an o-ring engaged to the flange for providing a secure fit between the flange and housing.

According to yet another embodiment of the present invention, the fuel tank assembly includes a pressure regulator mounted to the housing for regulating the pressure within the fuel filter.

According to yet another embodiment of the present invention, the fuel tank assembly includes a fuel reservoir extending away from the floor having at least one passage formed therein, the fuel reservoir positioned within the fuel tank so as to create an accumulated area of the fuel tank surrounding the at least one inlet, wherein fuel enters the accumulated area through the at least one passage for receipt by the at least one inlet of the housing.

According to yet another embodiment of the present invention, a fuel tank assembly includes a fuel tank having a plurality of walls spaced apart by a floor, a flange having a top portion and a bottom portion, and extending downward from one of the plurality of walls. The fuel tank assembly includes a housing, a crimp ring and a lip, wherein the crimp ring is fitted over the lip for engaging the flange and the housing. A fuel pump is housed within the housing, wherein the housing is arranged to fixedly position at least one inlet at or in close proximity to the floor of the fuel tank, and a fuel reservoir extends away from the floor having at least one passage formed therein, the fuel reservoir positioned within the fuel tank so as to create an accumulated area of the fuel tank surrounding the at least one inlet, wherein fuel enters the accumulated area through the at least one passage for receipt by the at least one inlet.

According to yet another embodiment of the present invention, the fuel tank assembly includes the fuel reservoir having a predetermined height relative to the floor that decreases along a path of the fuel reservoir defining the enclosed area, wherein the predetermined height becoming negligible prior to the fuel reservoir reaching one of the plurality of walls.

According to yet another embodiment of the present invention, the fuel tank includes the accumulated area and comprises a corner between two of the plurality of walls with the fuel reservoir extending between the two walls.

According to yet another embodiment of the present invention, the fuel tank assembly includes a channel positioned in the fuel reservoir.

According to yet another embodiment of the present invention, the fuel tank assembly includes a fuel tank having a plurality of walls spaced apart by a floor, and a flange having a top portion and a bottom portion, and extending downward from one of the plurality of walls. The fuel tank assembly further includes a housing a crimp ring and a lip, wherein crimp ring is fitted over the lip for engaging the flange and the housing, and a fuel pump housed within the housing, wherein the housing is arranged to fixedly position at least one inlet at or in close proximity to the floor of the fuel tank. At least one suction filter is positioned on the at least one inlet for filtering the fuel before introduction into the fuel pump, and a fuel reservoir extends away from the floor having at least one passage formed therein. The fuel reservoir is positioned within the fuel tank so as to create an accumulated area of the fuel tank surrounding the at least one suction filter inlet, wherein fuel enters the accumulated area through the at least one passage for receipt by the at least one suction filter.

According to yet another embodiment, a fuel tank assembly includes the fuel pump extending from a top wall of the fuel tank.

According to yet another embodiment of the present invention, a fuel tank assembly includes the fuel pump extending at an angle downward from one of the plurality of walls.

According to yet another embodiment of the present invention, the crimp ring is located on the flange and the lip is located on the housing.

According to yet another embodiment of the present invention, the crimp ring is located on the housing and the lip is located on the flange.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DESCRIPTION OF THE DRAWINGS

The present invention is illustrated and described herein with reference to the various drawings, in which like reference numbers denote like method steps and/or system components, respectively, and in which.

DETAILED DESCRIPTION OF THE INVENTION

Figure 1:
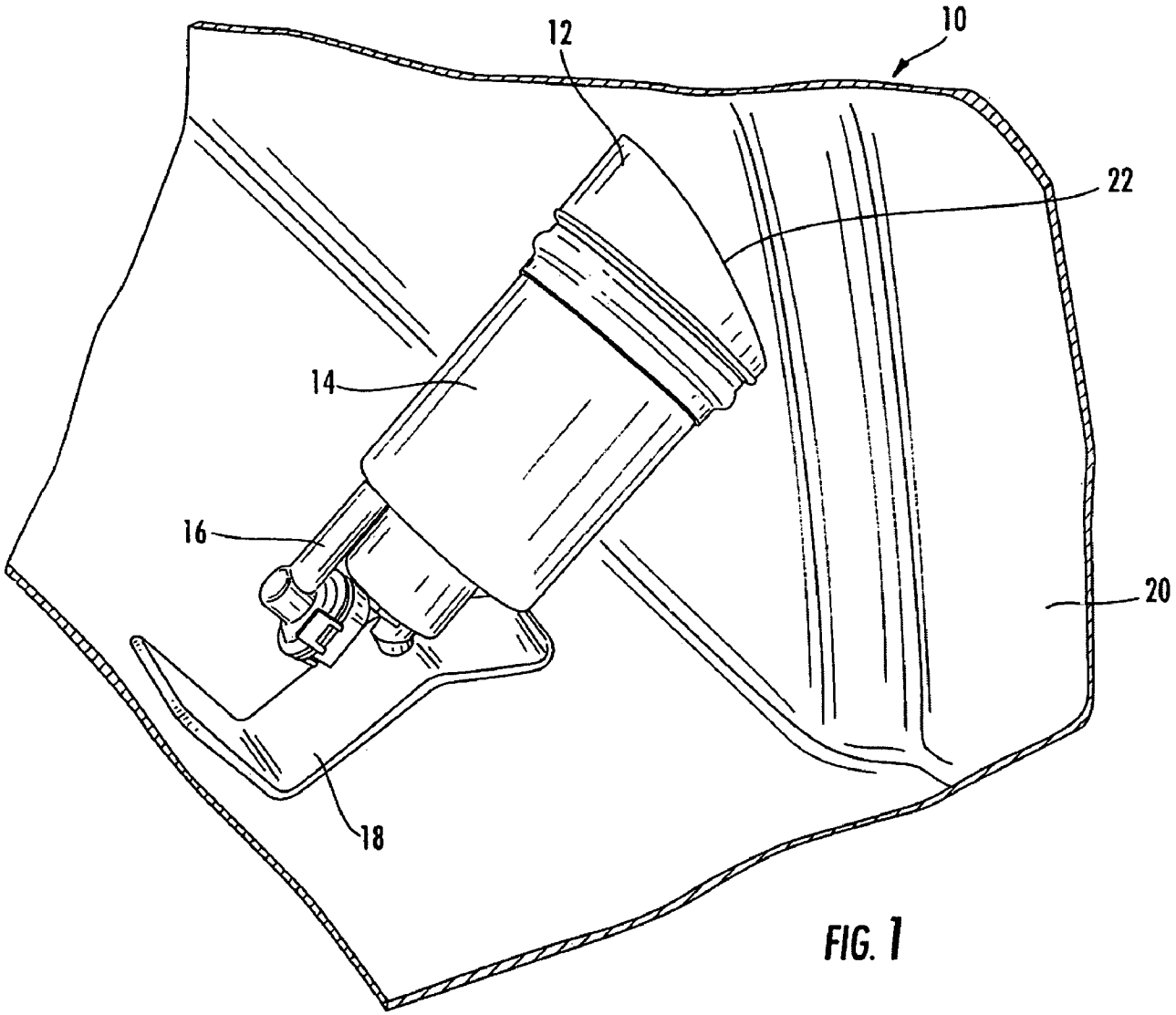
FIG. 1 shows a perspective view of a composite fuel tank assembly according to the present invention.

Referring to FIG. 1, a fuel tank assembly 10 according to an exemplary embodiment is shown, including a fuel pump assembly. The fuel pump assembly includes a flange 12, a housing 14, a fuel pressure regulator 16, and a suction filter 18. The flange 12 has a top portion and a bottom portion, and is further positioned on a wall of a fuel tank 20. The flange 12 can be positioned on a side wall of fuel tank 20 within a wall cavity 22 that is arranged to be adjacent to a vehicle exterior member (not shown) when the fuel tank assembly 10 is installed in a vehicle chassis (not shown). This arrangement enables the fuel tank assembly 10 to be accessed simply by removing, for example, a rear quarter panel (not shown) of a vehicle.

Figure 2:
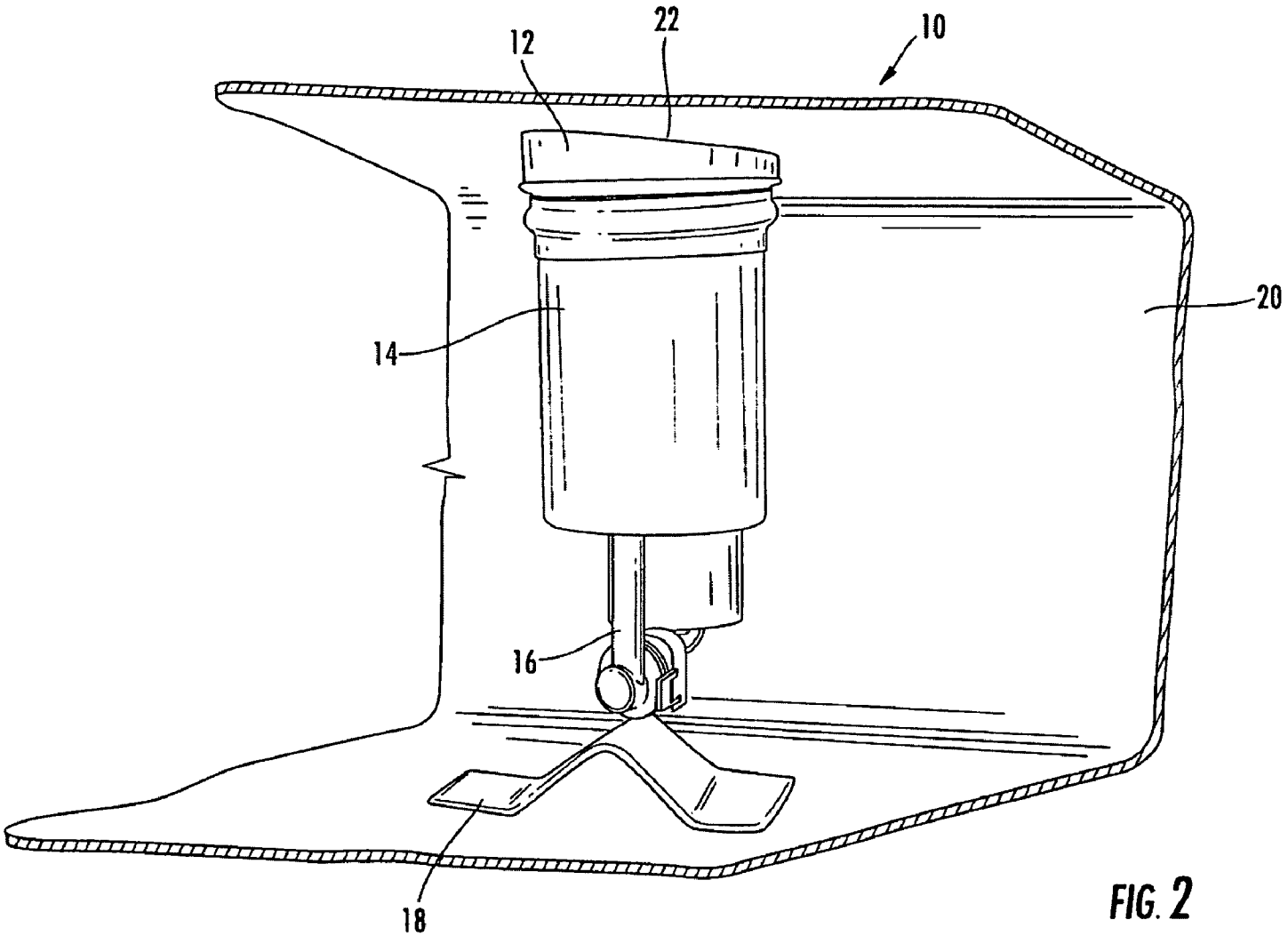
FIG. 2 shows an alternative placement of a fuel pump cartridge assembly according to the present invention.

In another arrangement, as shown in FIG. 2, the flange 12 can be positioned on the top wall of the fuel tank 20. This arrangement enables the fuel tank assembly 10 to be accessed simply be removing, for example, an access panel (not shown) of a vehicle located under a rear seat bottom.

Figure 3:
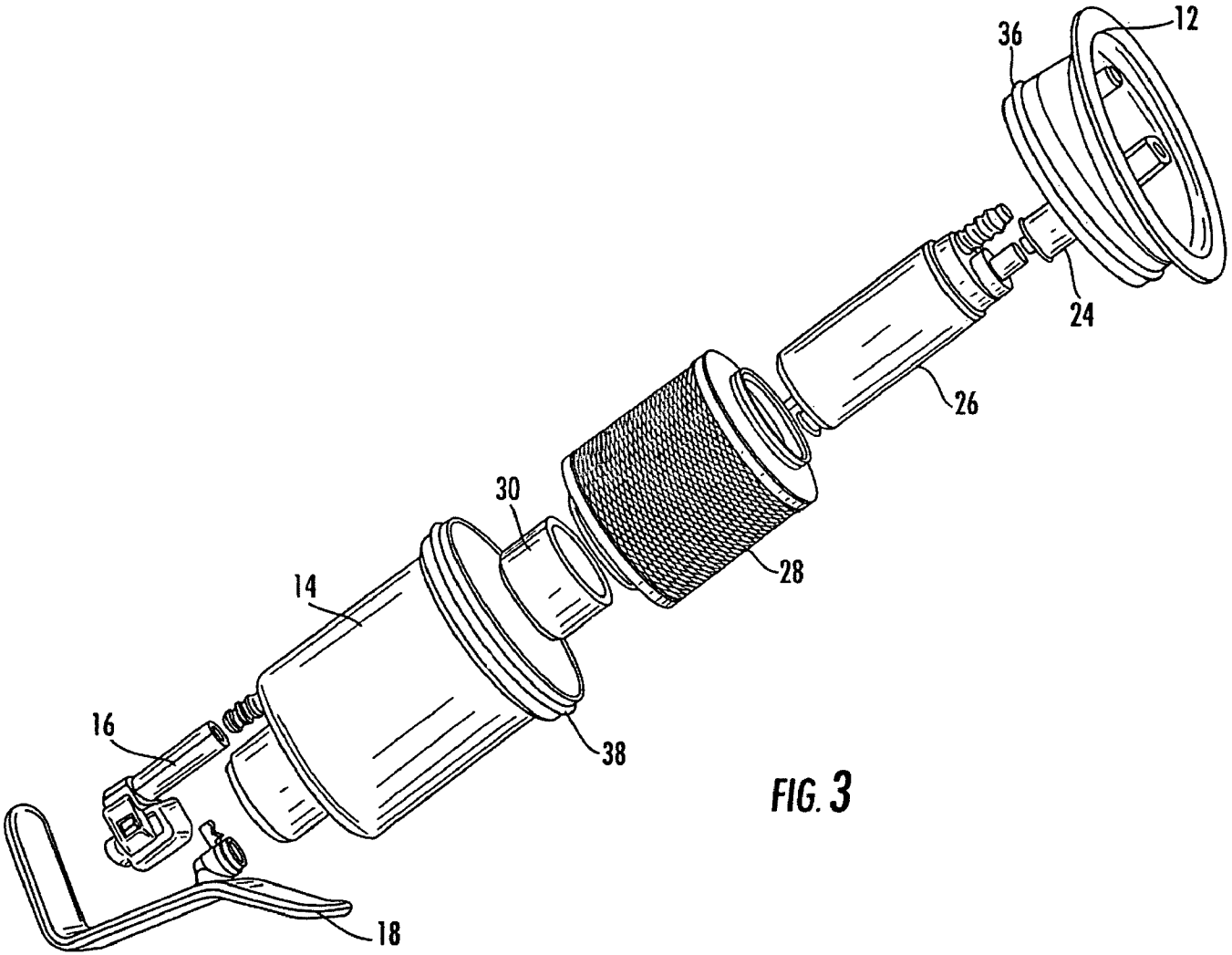
FIG. 3 shows an exploded view of one embodiment of a fuel tank assembly according to the present invention.

As illustrated in FIG. 3, the fuel tank assembly 10 comprises the flange 12 that fits within the wall cavity 22 of the fuel tank 20 (as illustrated in FIGS. 1 and 2), an optional electrical connected 24 that may be engaged to the flange 12, a housing 14, a fuel pump 26, a fuel filter 28, a grommet 30 to seal the pump to the housing 14, a pressure regulator 16, and suction filter 18. The electrical connector 24 may be engaged with the flange 12 for providing the requisite electricity to power the fuel pump 26. In one embodiment, neither the electrical connector 24 nor flange 12 is pressurized. Alternatively, an end of the fuel pump 26 may extend from within the flange 12 to receive power from an external source for operation, whereby the fuel pump 26 is sealed to the flange 12 with o-rings (not shown). Alternatively, the electrical connector 24 and the flange 12 may be pressurized.

The fuel filter 28 surrounds the fuel pump 26 for filtering the fuel, wherein the outer housing of the fuel pump 26 performs a secondary function as the inner wall of the fuel filter 28. This arrangement allows the elimination of an inner filter wall of the fuel filter 28. The housing 14 houses the fuel pump 26 and filter 28. A grommet 30 is used to securely retain the fuel pump 26 within the housing 14. The grommet 30 fits within a recess in the housing 14 having a diameter slightly larger than the diameter of the grommet 30. The grommet 30 has a diameter slightly larger than the diameter of the fuel pump 26, allowing the fuel pump 26 to be positioned within the grommet 30. The grommet 30 fits within the recess, and the fuel pump 26 fits within the grommet 30, thus preventing the fuel pump 26 from moving within the housing 14.

In one exemplary embodiment, the flange 12 includes a crimp ring 36 located on the periphery of the bottom portion of the flange 12. The crimp ring 36 may entirely cover the entire periphery of the bottom portion of the flange 12. Alternatively, the crimp ring 36 may be arranged in sections (not shown) upon the periphery of the bottom portion of the flange 12. Specifically, the crimp ring 36 may be composed of multiple spaced apart crimp rings 36 located around the periphery of the bottom portion of the flange 12 (not shown). The purpose of the crimp ring 36 is to engage the flange 12 with the housing 14.

The housing 14 includes a lip 38 located on the upper portion of the housing 14. The crimp ring 36 is designed to be fitted over the lip 38 of the housing, creating an engaged arrangement between the flange 12 and housing 14. The crimp ring 36 is fitted over the entire area of the lip 38 or a portion of the lip 38, forming a single, solitary arrangement. This arrangement is designed to form a solid, substantially leak prevention seal that prevents the intrusion of the gas within the assembly 10. The flange 12, housing 14, crimp ring 36, and lip 38 may be composed of stainless steel, or other metal, wherein the crimp ring 36 and lip 38 may be laser welded together to form an engaged arrangement.

Alternatively, this exemplary embodiment also allows dissimilar materials to be joined together to form the flange 12 and housing 14 arrangement. For example, the flange 12 may be composed of stainless steel, or other type of suitable steel, while the housing 14 is composed of plastic. The stainless steel crimp ring 36 may be formed over the plastic lip 38 of the housing 14, forming a single, solitary arrangement of the flange 12 and housing 14 that are composed of dissimilar materials. In another exemplary embodiment, any type of metal or composite material may compose the flange 12 and crimp ring 36, which is engaged to the housing 14 and lip 38 composed of plastic or a composite material. In still yet another exemplary embodiment, the housing 14 may be made of plastic or a composite material, and the lip 38 may be composed of another material, such as a metal, while the housing 14 is composed of a separate material, such as plastic. In still yet another exemplary embodiment, the crimp ring 36 may be plastic, and the lip 38 composed of steel or similar metal. In still yet another exemplary embodiment, the crimp ring 36 may be plastic and the lip 38 composed of plastic.

Figure 4:
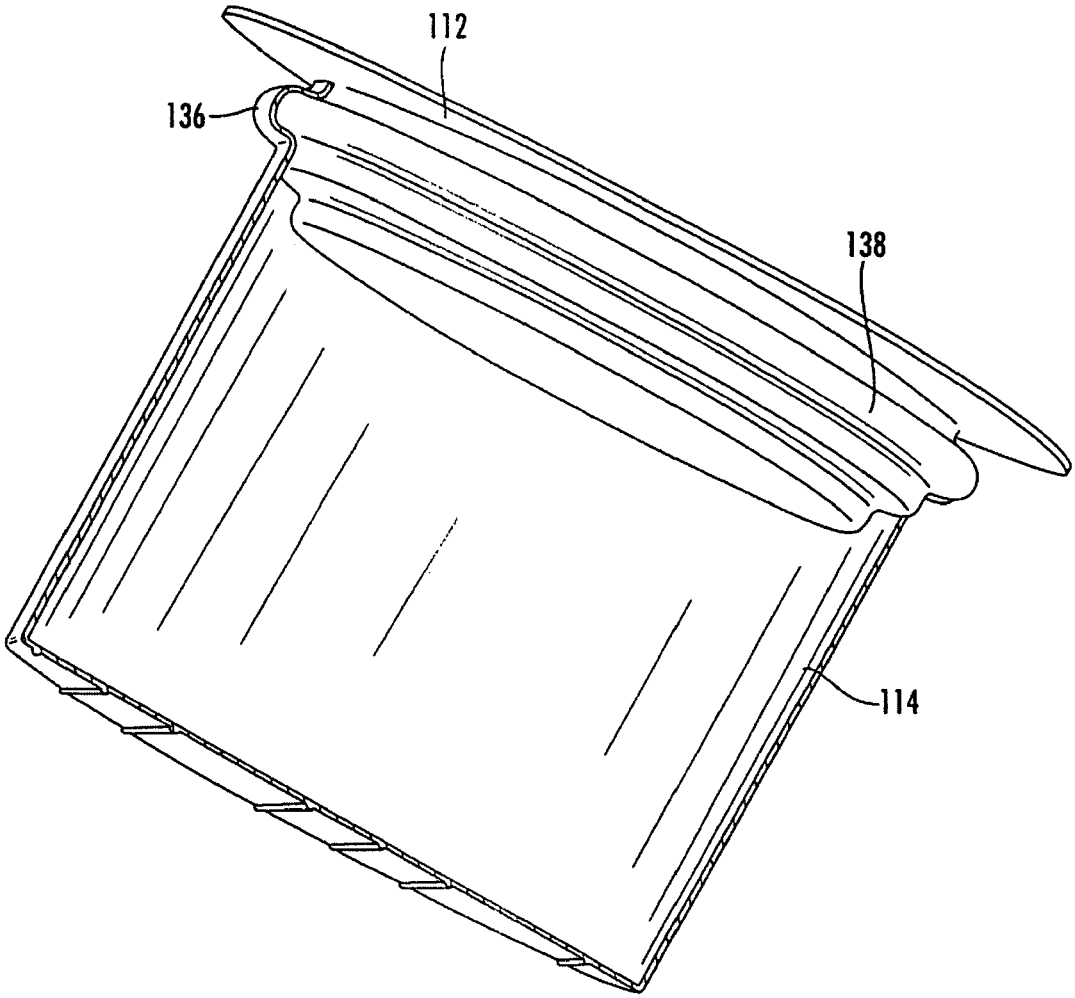
FIG. 4 shows a side view of one embodiment of a composite fuel pump assembly according to the present invention.

Another exemplary embodiment of the present invention is illustrated in FIG. 4. In this embodiment, the flange 112 comprises a lip 138, for receiving a crimp ring 136 located on the top portion of the housing 114. The housing 114 includes a crimp ring 136 located on the upper portion of the housing 114. The crimp ring 136 is designed to be fitted over the lip 138 of the flange 112, creating an engaged arrangement between the flange 112 and housing 114. The crimp ring 136 is fitted over the entire area of the lip 138 or a portion of the lip 138, forming a single, solitary arrangement. This arrangement is designed to form a solid, substantially leak preventing seal that prevents the intrusion of the gas within the housing 114. In addition, an o-ring 144 may be engaged to the flange 112 for providing a secure fit between the flange 112 and housing 114, as illustrated in FIG. 5.

Figure 5:
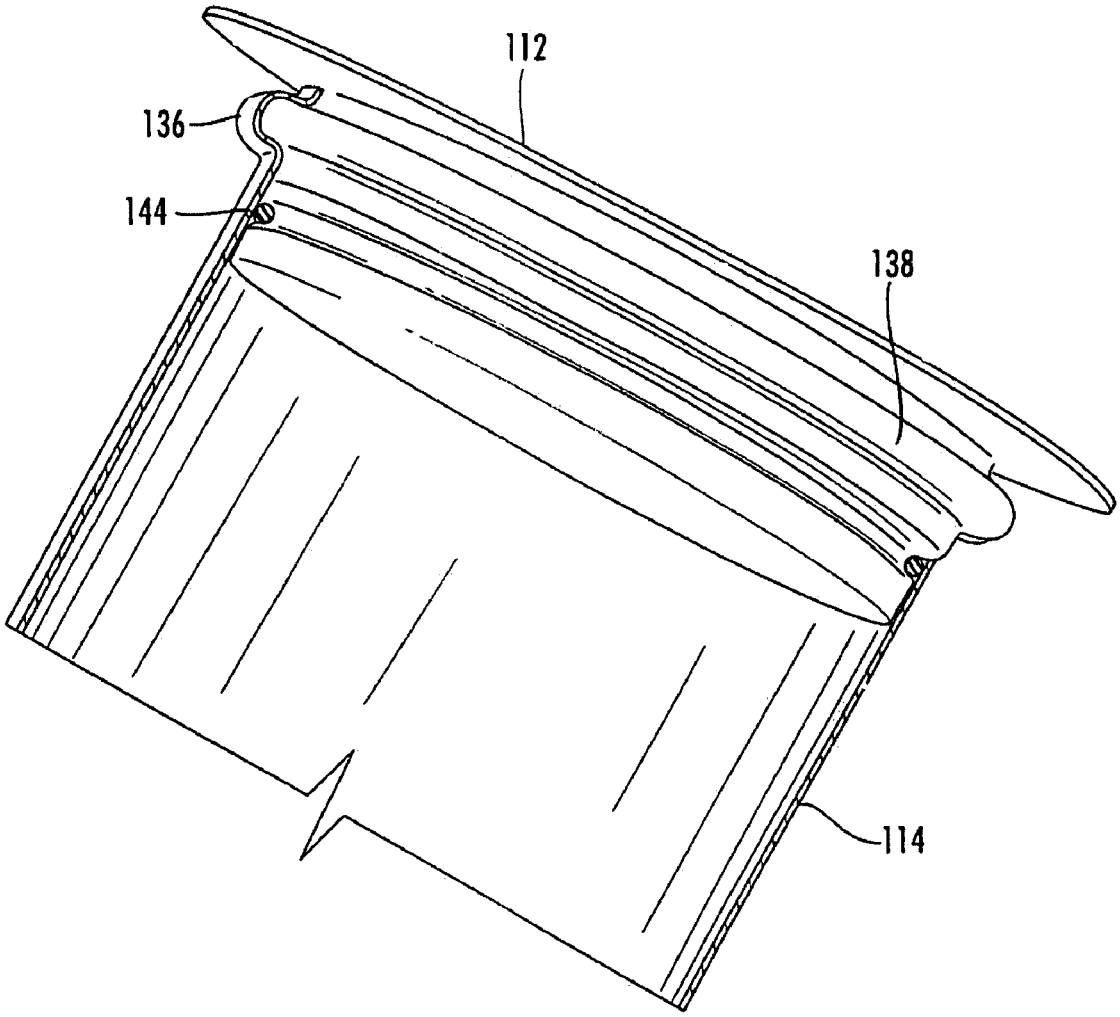
FIG. 5 shows another side view of one embodiment of a composite fuel pump assembly according to the present invention.
Figure 6:
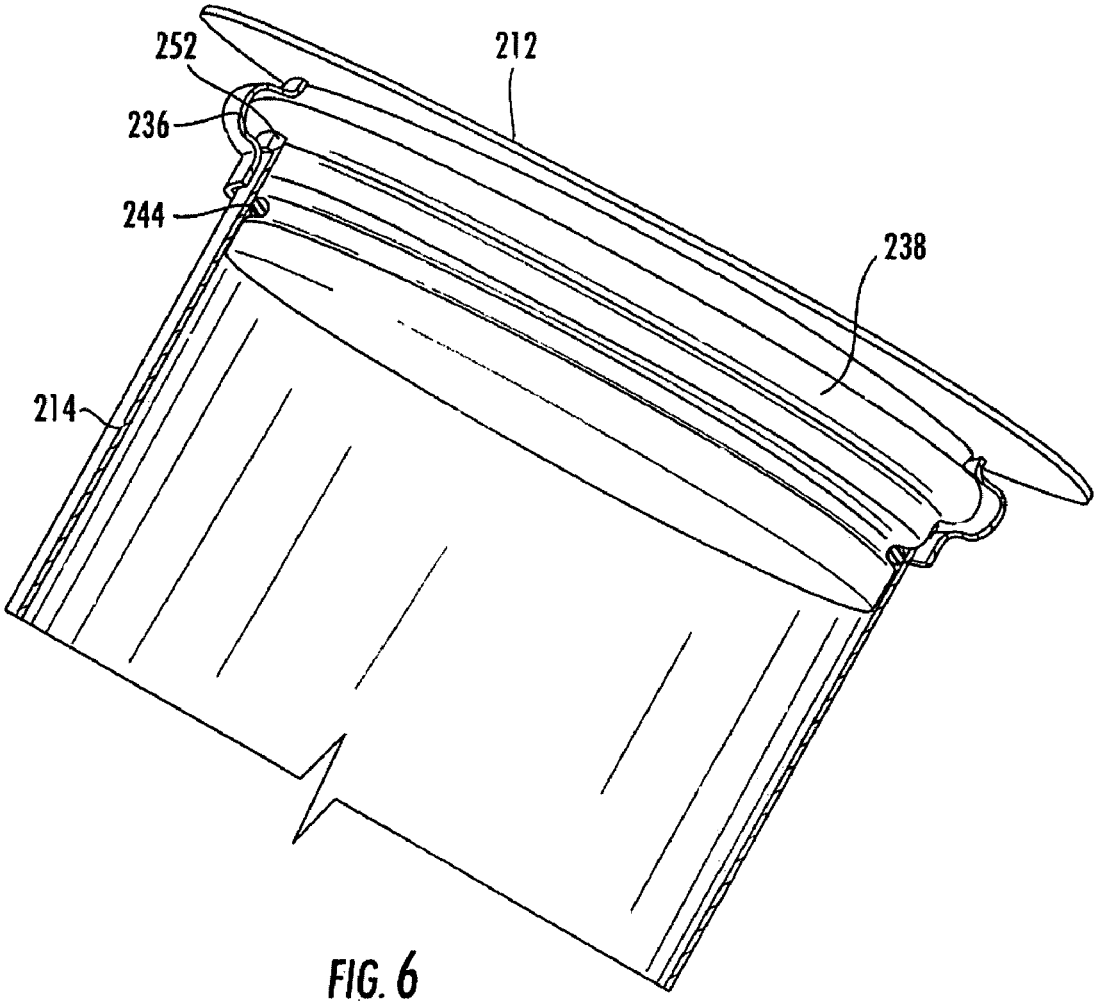
FIG. 6 shows another side view of one embodiment of the composite fuel pump assembly according to the present invention.

An exemplary embodiment of the present invention is illustrated in FIG. 6 and is a derivation of FIGS. 4 and 5. This particular embodiment includes a second lip 252 located upon the upper portion of the housing 214. The flange 212 is engaged to the housing by way of a crimp ring 236. The crimp ring 236 is fitted over the lip 238 of the flange 212 and the lip 252 of the housing 214. An o-ring 244 is optionally engaged to the flange for providing a secure fit between the housing 214 and flange 212.

Figure 7:
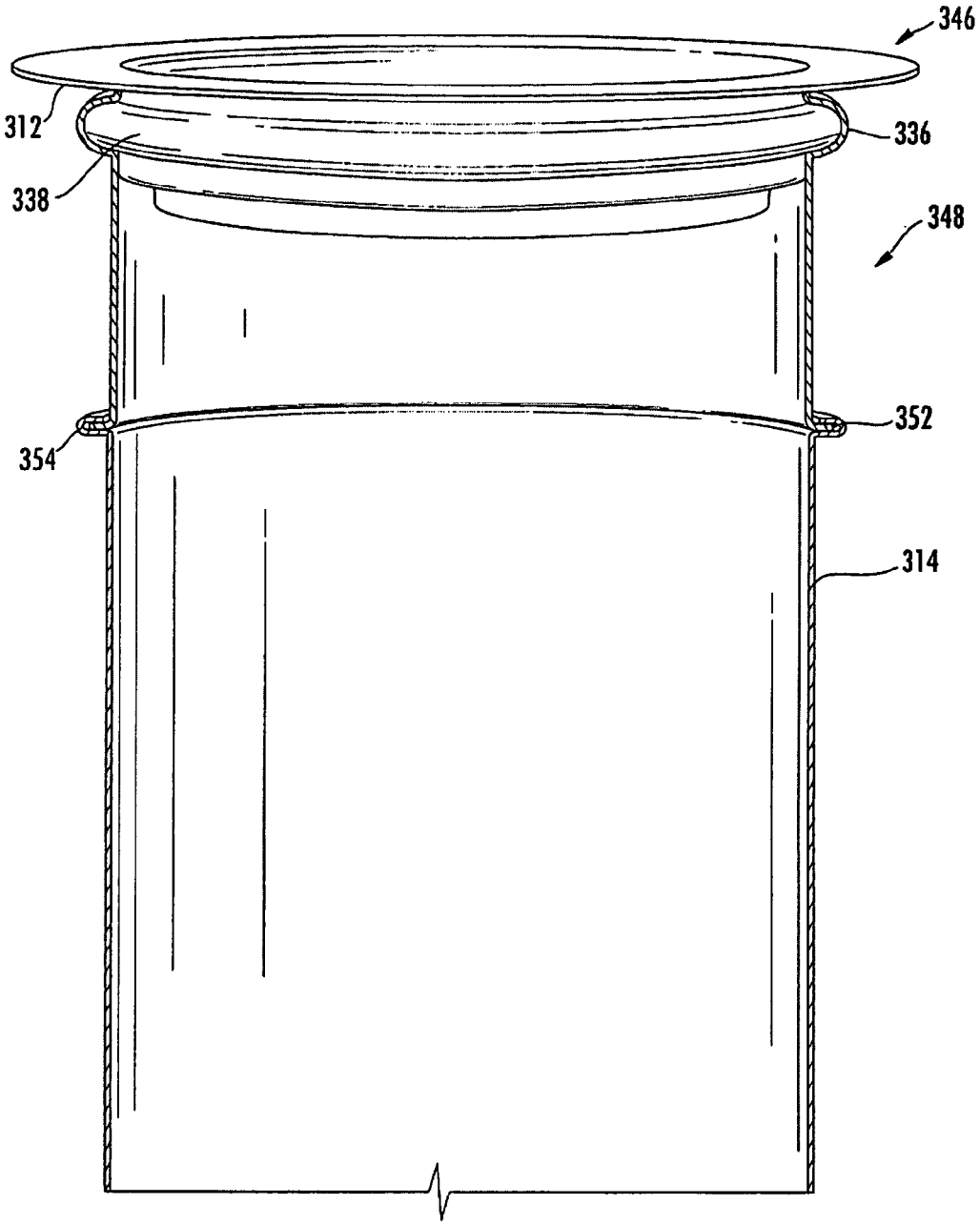
FIG. 7 shows another side view of one embodiment of the composite fuel pump assembly according to the present invention.

An exemplary embodiment of the present invention is shown in FIG. 7. This embodiment includes a flange 312 comprising a lip 338, for receiving a crimp ring 336. The crimp ring 336 is designed to engage the flange 312. The crimp ring 336 is designed to be fitted over the lip 338 of the flange 312, creating an engaged arrangement between the flange 312. The crimp ring 336 is fitted over the entire area of the lip 338 or a portion of the lip 338, forming a single, solitary arrangement. Alternatively, the flange 312 may include a crimp ring for being fitted over a lip located on the housing.

In this embodiment as illustrated in FIG. 7, the flange 312 may consist of an upper portion 346 and a lower portion 348. The upper portion 346 comprises a second lip 352, for receiving a second crimp ring 354 located on the lower portion 348. The lower portion 348 includes a second crimp ring 354 for engaging the flange 312 to the housing 314. The second crimp ring 354 is designed to be fitted over the second lip 352 of the flange 312, creating an engaged arrangement between the flange 312 and housing 314. The second crimp ring 354 may be welded or roll-crimped to the second lip 352. An o-ring (not shown) may be engaged to the flange 312, for providing a secure fit between the flange 312 and housing 314.

Figure 8:
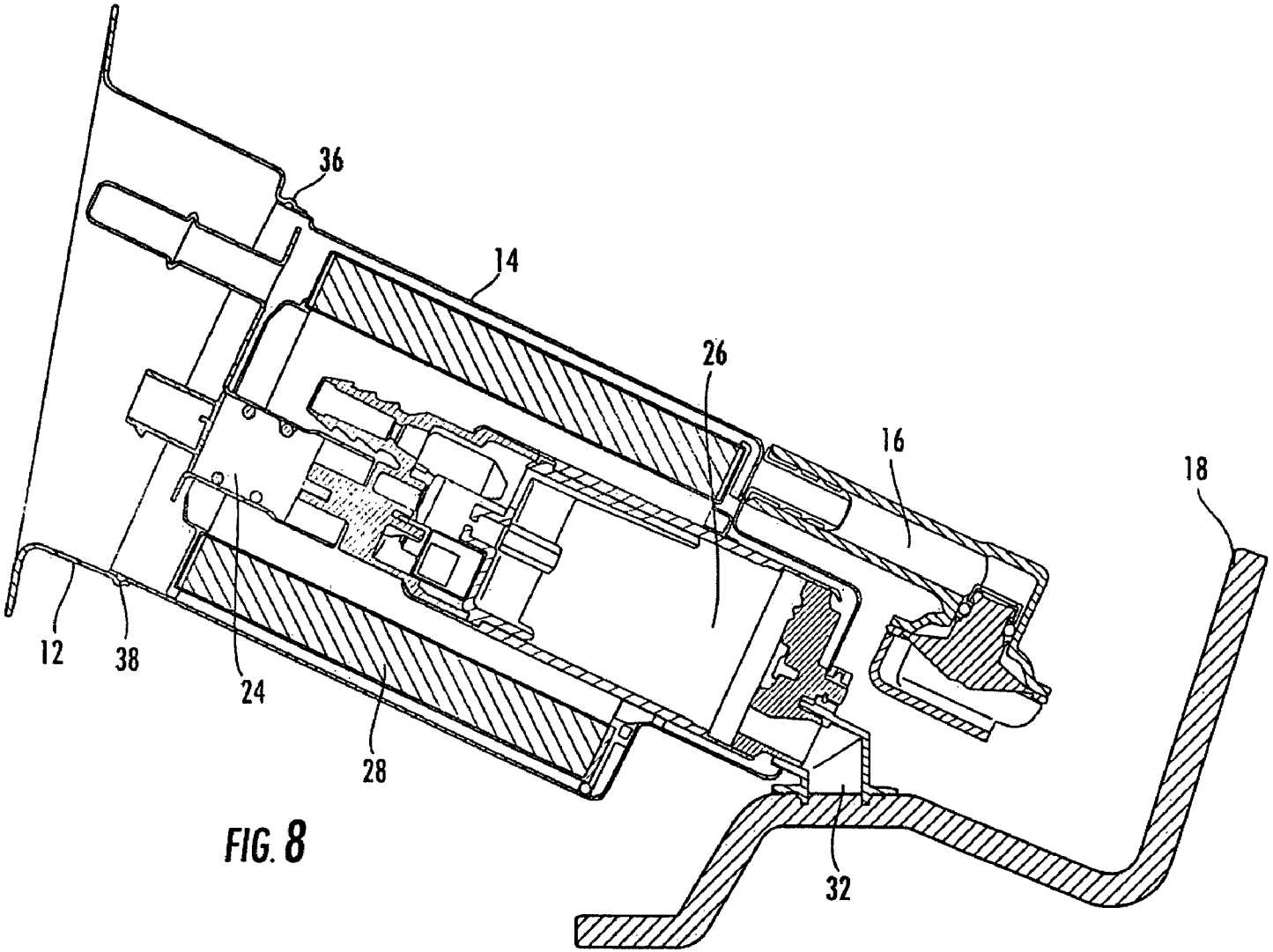
FIG. 8 shows a cross-sectional view of an exemplary embodiment of a composite fuel pump assembly according to the present invention.

As illustrated in FIG. 8, the pressure regulator 16 regulates the system pressure within the fuel pump 26. The suction filter 18 may be connected to the inlet 32 of the fuel pump 26 and draws fuel from the fuel tank 20 and into the housing 14. The suction filter 18 filters the fuel as it is drawn into the housing 14 from the fuel tank 20 for protecting the fuel injectors, as illustrated in FIGS. 1 and 2. The suction filter 18 includes an internal frame member, allowing the suction filter 18 to be formed into a particular shape beneficial for the intake of fuel.

As shown in FIGS. 1, 2, and 3, the internal frame member can be formed in a number of different arrangements based upon a desired function. In FIG. 1, the suction filter 18 may be formed to include an arch extending away from the housing 14 and a flat portion for positioning on the floor of the fuel tank 20 or in close proximity to the floor of the fuel tank 20. The positioning of the suction filter 18 on the floor of the fuel tank 20, allows the suction filter 18 to perform a wicking function for drawing fuel into the suction filter 18 during the intake of fuel. In addition, the design of the suction filter 18, allows the flange 12 and housing 14 to be suspended above the floor of the fuel tank 20. Alternatively, the suction filter 18 includes an arch that is similar to an "A-shape," wherein the highest point on the suction filter 18 is attached to the inlet 32 and the two opposite ends of the suction filter 18 are disposed on the gas tank 20 floor, or in close proximity to the floor.

As shown in FIG. 8, the fuel pump 26 contains an inlet 32 for receiving, fuel that has previously been filtered by the suction filter 18. The suction filter 18 provides a first filtering of the fuel from the tank 20 for protecting the fuel pump 26. The fuel is drawn through the suction filter 18, through the inlet 32, and deposited within the housing 14. The fuel is then drawn through the fuel filter 28, thus filtering the fuel, before the fuel is pumped to the fuel injectors.

The flange 12 and housing 14 substantially fit within the fuel tank 20, and are suspended above the floor of the fuel tank 20. The suction filter 18 may touch the floor of the fuel tank 20, while the housing 14 and pressure regulator 32 are suspended above the floor. Alternatively, the suction filter 18 is in close proximity to the floor of the fuel tank 20, while the housing 14 and pressure regulator 32 are suspended above the floor.

Figure 9:
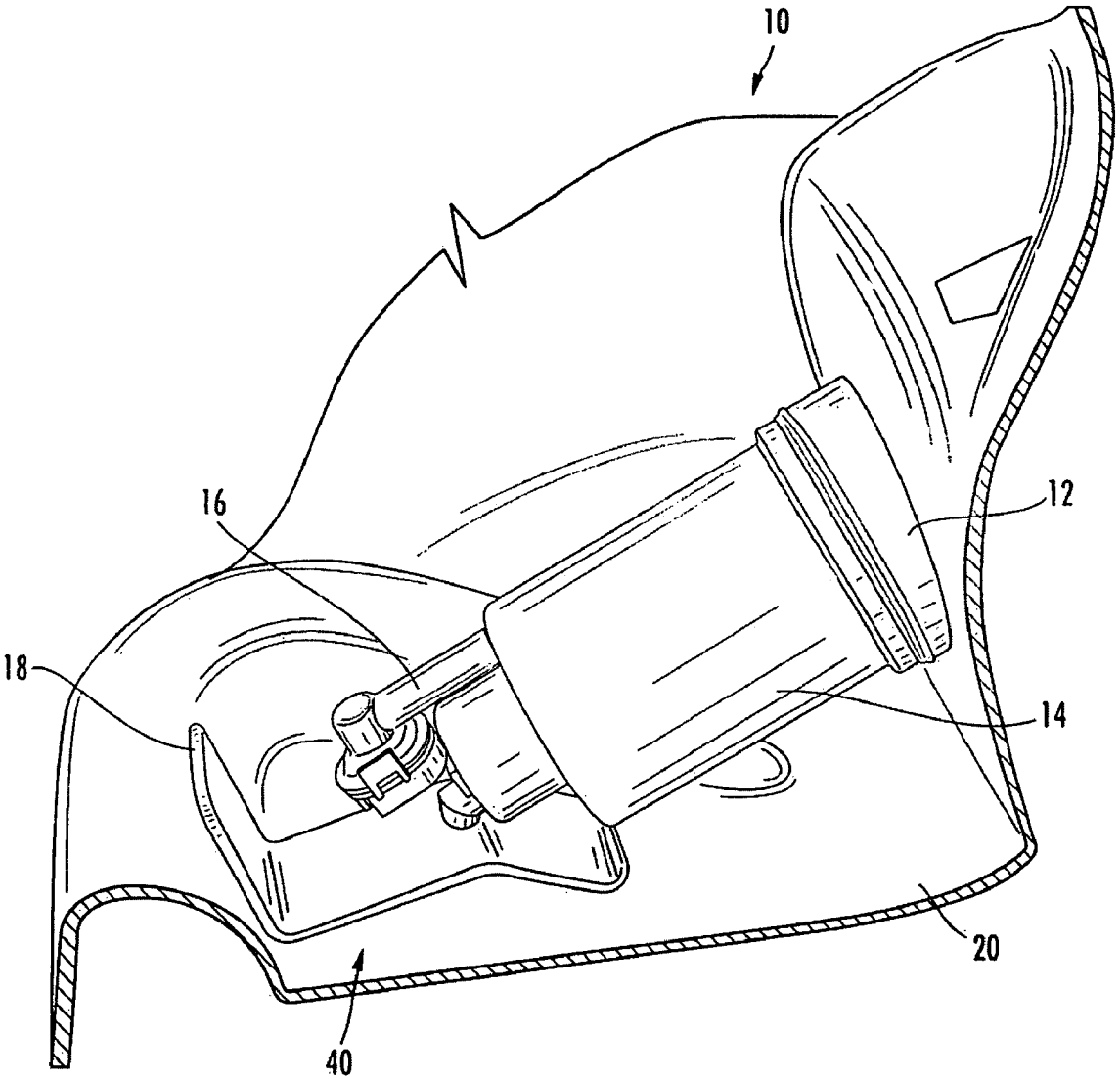
FIG. 9 shows a perspective view of a fuel tank assembly having a fuel reservoir according to the present invention.
Figure 10:
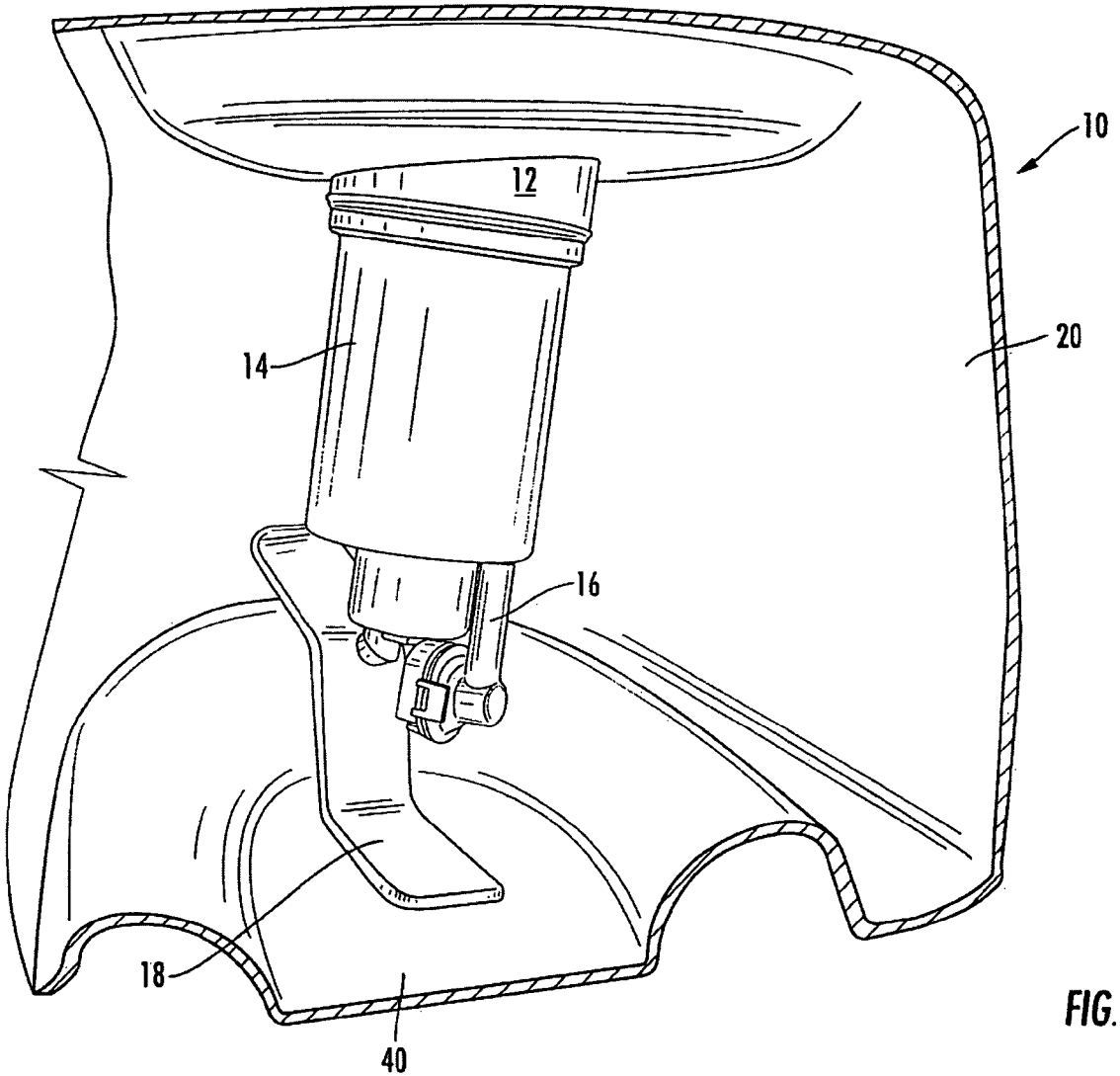
FIG. 10 shows a perspective view of a fuel tank assembly having a fuel reservoir according to the present invention.
Figure 11:
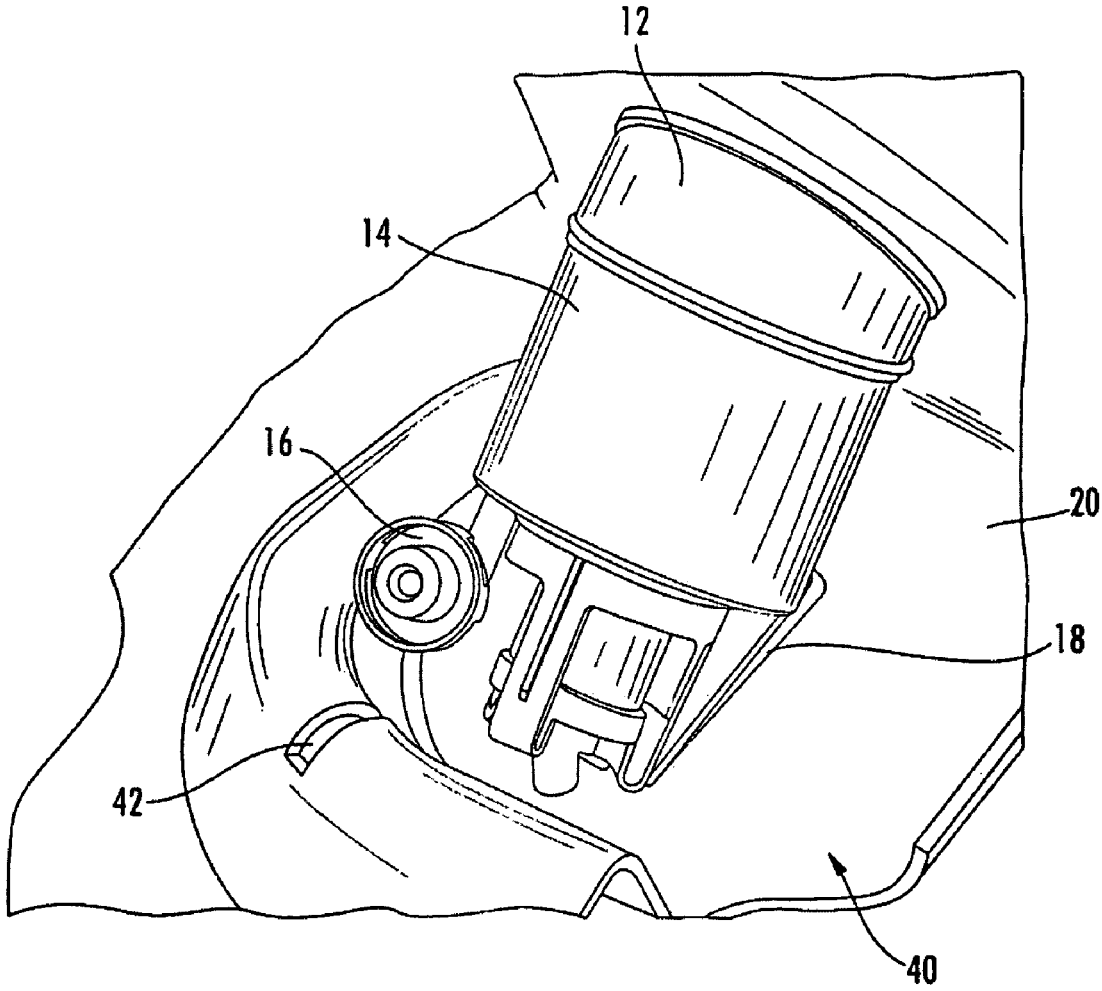
FIG. 11 shows a perspective view of another embodiment of the fuel tank assembly having a fuel reservoir according to the present invention.

Referring to FIGS. 9, 10, and 11, the fuel tank assembly 10 is shown according to an exemplary embodiment to include a fuel reservoir 40 positioned on the floor of the fuel tank 20. According to an aspect of the present invention, the fuel reservoir 40 can be an integrally molded or formed cavity or partition extending upward from the floor of the fuel tank 10, and following a path that generally encircles the fuel pump assembly 10. The fuel reservoir 40 may extend from a side wall of the fuel tank 20 and encloses the fuel pump assembly 10 against the side wall. According to a another exemplary embodiment, the fuel reservoir 40 extends from one side wall to another side wall of the fuel tank 20 and encloses the fuel pump assembly 10 in a corner of the fuel tank 20. In accordance with another aspect of the present invention, the fuel reservoir 40 also includes at least one channel 42 for receiving at least one remote inlet of the pump (not shown).

The fuel reservoir 40 depicted in FIGS. 9, 10, and 11 is vital in preventing damage to the fuel pump 26, and vital engine components. For example, when a vehicle is low on fuel and travels around a curve, the small amount of fuel within the fuel tank 20 will be forced to the side of the fuel tank 20 away from the curve. In many instances, this removes gas from the suction filter 18 or pump inlet 32, thus preventing gas from entering the fuel pump 26. When gas does not enter the fuel pump 26, the fuel pump 26 still operates, but without the fuel that serves a secondary purpose as a type of lubricant to reduce wear on a pump's internal compartments, providing a liquid surface boundary. As the fuel pump 26 has no fuel to pump throughout the system, the engine has no fuel to use in the combustion process, resulting in no fuel or a less than adequate amount of fuel to be expelled into the combustion chamber, possibly resulting in a misfire.

The fuel reservoir 40 prevents all of the gas from freely flowing within the fuel tank 20. The fuel reservoir 40 keeps an adequate amount of fuel within the reservoir 40, allowing the fuel pump 26 to pump fuel through the fuel pump 26 and into the engine. Because of the fuel reservoir 40, fuel is in close proximity to the suction filter 18 or inlet 32, even when a car makes a sharp turn, or other maneuver that would affect the gas within the fuel tank 20.

According to either exemplary embodiment, the floor of the fuel tank 10 may be sloped downward in the direction of the fuel pump assembly 10. In addition, the fuel reservoir 40 includes a passage allowing fuel to enter an accumulated or "pooled" area. According to an aspect of the present invention, the passage can be formed by the height of the fuel reservoir 40 generally decreasing along the path and becoming negligible as the path approaches the side wall of the fuel tank 20. As a result, fuel will flow around the fuel reservoir 40 and into an area enclosed by the fuel reservoir 40. Furthermore, the fuel reservoir 40 is arranged to retain a quantity of fuel within an area defined by the path. This arrangement is relevant when small quantities of fuel remain in the fuel tank 20 as the floor and the fuel reservoir 40 ensure that fuel remains available to suction filter 18, without the use of a reservoir within the tank.

The description of the invention is merely exemplary in nature, and thus variations that do not depart from the gist of the invention are intended to be within the scope of the invention. Such variations are not to be regarded as a departure from the spirit and scope of the invention.

What is claimed is:

1. A fuel tank assembly comprising:

a fuel tank including a plurality of walls defining an inner volume;

a flange extending from one of said plurality of walls and including a first surface defining an opening into said inner volume and a second surface formed on an opposite side of said flange from said first surface and opposing at least one of said plurality of walls within said inner volume; and a fuel pump assembly including a housing encircling said flange to attach said fuel pump assembly to said flange at said second surface.

2. The fuel tank assembly of claim 1, further comprising a crimp ring that engages said flange and said housing to attach said housing to said flange.

3. The fuel tank assembly of claim 1, wherein said flange is formed from a different material than said housing.

4. The fuel tank assembly of claim 1, wherein said flange is formed from metal and said housing is formed from at least one of a plastic material and a composite material.

5. The fuel tank assembly of claim 1, wherein said flange and said housing are formed from the same material.

6. The fuel tank assembly of claim 1, wherein said housing is disposed between said second surface and said plurality of walls when said housing is attached to said second surface within said inner volume.

7. The fuel tank assembly of claim 1, wherein said flange includes a lip and said housing includes a crimp ring, said crimp ring engaging said lip to attach said housing to said flange.

8. The fuel tank assembly of claim 1, wherein said flange includes a first lip and said housing includes a second lip, said second lip engaging said first lip to attach said housing to said flange.

9. The fuel tank assembly of claim 1, further comprising a seal disposed between said second surface and said housing.

10. The fuel tank assembly of claim 1, wherein said first surface and said second surface cooperate to provide said flange with a substantially cylindrical shape.

11. A fuel tank assembly comprising:

a fuel tank including a plurality of walls defining an inner volume;

a flange extending from one of said plurality of walls and including a first surface defining an opening into said inner volume and a second surface formed on an opposite side of said flange from said first surface and opposing at least one of said plurality of walls within said inner volume; and a fuel pump assembly including a housing attached to said flange at said second surface such that said housing is disposed between said second surface and said walls of said fuel tank when said housing is attached to said flange.

12. The fuel tank assembly of claim 11, further comprising a crimp ring that engages said flange and said housing to attach said housing to said flange.

13. The fuel tank assembly of claim 11, wherein said flange is formed from a different material than said housing.

14. The fuel tank assembly of claim 11, wherein said flange is formed from metal and said housing is formed from at least one of a plastic material and a composite material.

15. The fuel tank assembly of claim 11, wherein said flange and said housing are formed from the same material.

16. The fuel tank assembly of claim 11, wherein said housing encircles said flange at said second surface.

17. The fuel tank assembly of claim 11, wherein said flange includes a lip and said housing includes a crimp ring, said crimp ring engaging said lip to attach said housing to said flange.

18. The fuel tank assembly of claim 11, wherein said flange includes a first lip and said housing includes a second lip, said second lip engaging said first lip to attach said housing to said flange.

19. The fuel tank assembly of claim 11, further comprising a seal disposed between said second surface and said housing.

20. The fuel tank assembly of claim 11, wherein said first surface and said second surface cooperate to provide said flange with a substantially cylindrical shape.

* * * * *